US005180113A

United States Patent [19]

Gehrke

[11] Patent Number: 5,180,113

[45] Date of Patent: Jan. 19, 1993

[54] PULVERIZING TECHNIQUE AND ROLLING MILL FOR USE THEREIN

[75] Inventor: Bodo Gehrke, Hemmingen, Fed. Rep. of Germany

[73] Assignee: EVT Energie- und Verfahrenstechnik GmbH, Stuttgart, Fed. Rep. of Germany

[21] Appl. No.: 648,225

[22] Filed: Jan. 31, 1991

[30] Foreign Application Priority Data

Feb. 1, 1990 [DE] Fed. Rep. of Germany ..... 4002867

[51] Int. Cl.[5] ..... B02C 15/00

[52] U.S. Cl. ..... 241/79.1; 241/119; 241/121; 209/139.1

[58] Field of Search ..... 241/79.1, 98, 119, 121; 209/139.1, 139.2

[56] References Cited

U.S. PATENT DOCUMENTS

| | | | |
|---|---|---|---|
| 3,656,618 | 4/1972 | Janich | 209/139.2 |
| 3,807,552 | 4/1974 | Gotthard | 209/139.2 X |
| 3,960,714 | 6/1976 | Strauss | 209/139.2 |
| 4,504,018 | 3/1985 | Diggins | 241/79.1 X |
| 4,541,574 | 9/1985 | Gygi | 241/152 A X |
| 4,597,537 | 7/1986 | Misaka et al. | 241/79.1 |
| 4,869,434 | 9/1989 | Folsberg | 241/119 X |
| 4,869,786 | 9/1989 | Hanke | 209/139.2 |
| 4,927,086 | 5/1990 | Henne et al. | 241/119 X |

FOREIGN PATENT DOCUMENTS

| | | | |
|---|---|---|---|
| 624496 | 1/1936 | Fed. Rep. of Germany | 241/119 |
| 1938772 | 6/1980 | Fed. Rep. of Germany . | |

*Primary Examiner*—Mark Rosenbaum
*Assistant Examiner*—Frances Chin
*Attorney, Agent, or Firm*—Chilton, Alix & Van Kirk

[57] ABSTRACT

Vibration in the operation of a rolling mill is minimized by mixing unground raw material with partially ground material being recirculated in such a manner that the material fed to the bowl of the mill is homogeneously mixed whereby variations in the frictional forces within the bowl will be reduced. If necessary, the moisture content of the mixture being fed into the mill bowl may be increased to ensure that the grinding operation is performed efficiently.

8 Claims, 2 Drawing Sheets

PULVERIZING TECHNIQUE AND ROLLING MILL FOR USE THEREIN

BACKGROUND OF THE INVENTION

1. Field of the Invention

The present invention relates to the pulverizing of solid material and particularly to the production of a stream of finely pulverized coal entrained in a carrier gas. More specifically, this invention is directed to a grinding mill, wherein coarse material separated from a stream of pulverized material entrained in a carrier gas is mixed with incoming unpulverized raw material and the mixture subsequently delivered to grinding apparatus, and especially to a bowl mill which includes at least a first stirrer located immediately upstream, in the direction of incoming material flow, of the rotary bowl. Accordingly, the general objects of the present invention are to provide novel and improved methods and apparatus of such character.

2. Description of the Prior Art

Rolling mills, and particularly bowl mills, are well known in the art and, for example, are employed in the production of finely pulverized coal which is subsequently entrained in a carrier gas and used for charging steam generators of the type employed by electrical utilities. In a conventional rolling mill type pulverizer as employed by an electrical utility, "raw" coal is fed into a revolving bowl where size reduction takes place by virtue of the coal being crushed by rotating rolls. The partially pulverized coal passes over the edge of the bowl and is entrained in a stream of gas. This gas stream may, for example, comprise hot air which causes drying of the partially pulverized coal. The entrained particulate material is carried upwardly into a separator located above the bowl. The separator rejects the larger particles which are returned to the bowl for further grinding. The fine particles which are not separated and returned to the grinding zone will pass from the mill and typically be delivered to the furnace for combustion.

A rolling mill of the type generally described above is shown, for example, in brochure 3000.KO 4/88 entitled "Bowl Mills" published by EVT Energie and Verfahrenstechnik GmbH of Stuttgart, Federal Republic of Germany. The mills shown in the aforementioned brochure are mainly used for grinding hard coal to produce coal dust for use in the charging of steam generators.

In the prior art, excessive vibration has often been encountered during the operation of bowl mills, particularly during grinding to a high level of fineness. It has been discovered that the vibration, and a related decrease in mill efficiency, results from a poor mixing of the feed material, the raw coal for example, with the partially pulverized material returned to the bowl from the separator. As a consequence of this poor mixing, the frictional forces between the mill rollers and the material being milled, or between the mill bowl and the material being milled, or within the material being milled itself, are not constant and the power required to drive the mill thus fluctuates. In addition, it is known that the power consumption of a pressure-stressed grinding material layer, as is present in a bowl mill, is dependent upon grain formation and the moisture content of the material being ground. Thus, in summary, the best grinding performance is achieved with a homogeneously mixed grinding material having the proper moisture content.

SUMMARY OF THE INVENTION

The present invention overcomes the above-briefly discussed and other deficiencies and disadvantages of the prior art by providing for the intimate mixing of the material being directed to the bowl of a rolling mill from two separate sources. The two sources will respectively supply the raw material which is to be pulverized and partially pulverized material which is being recirculated for further grinding.

Apparatus in accordance with the present invention comprises a stirring system located immediately upstream, in the direction of incoming material flow, of the bowl of a rolling mill. The stirring system is positioned such that it will intercept the material from both sources, i.e., the raw material and the partially pulverized material being recirculated. The stirring system may comprise one or more stirrers. Thus, a first stirrer may be coupled to, and thus rotated by, the same drive which supplies power to a rotary-type classifier which separates the coarse particles from the partially pulverized material. Alternately, the stirrer may be coupled to, and thus driven by, the drive which imparts rotation to the mill bowl. If necessary or desirable, two serially arranged stirrers may be employed with one being driven by the separator drive and the other being driven by the bowl drive. When a pair of stirrers are employed, they may be driven either in the same direction or in opposite directions.

Apparatus in accordance with the present invention also includes, in the vicinity of the stirring devices or devices, means for injecting water into the region where the mixing of the raw and recirculated material occurs.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENTS

Figure 1:
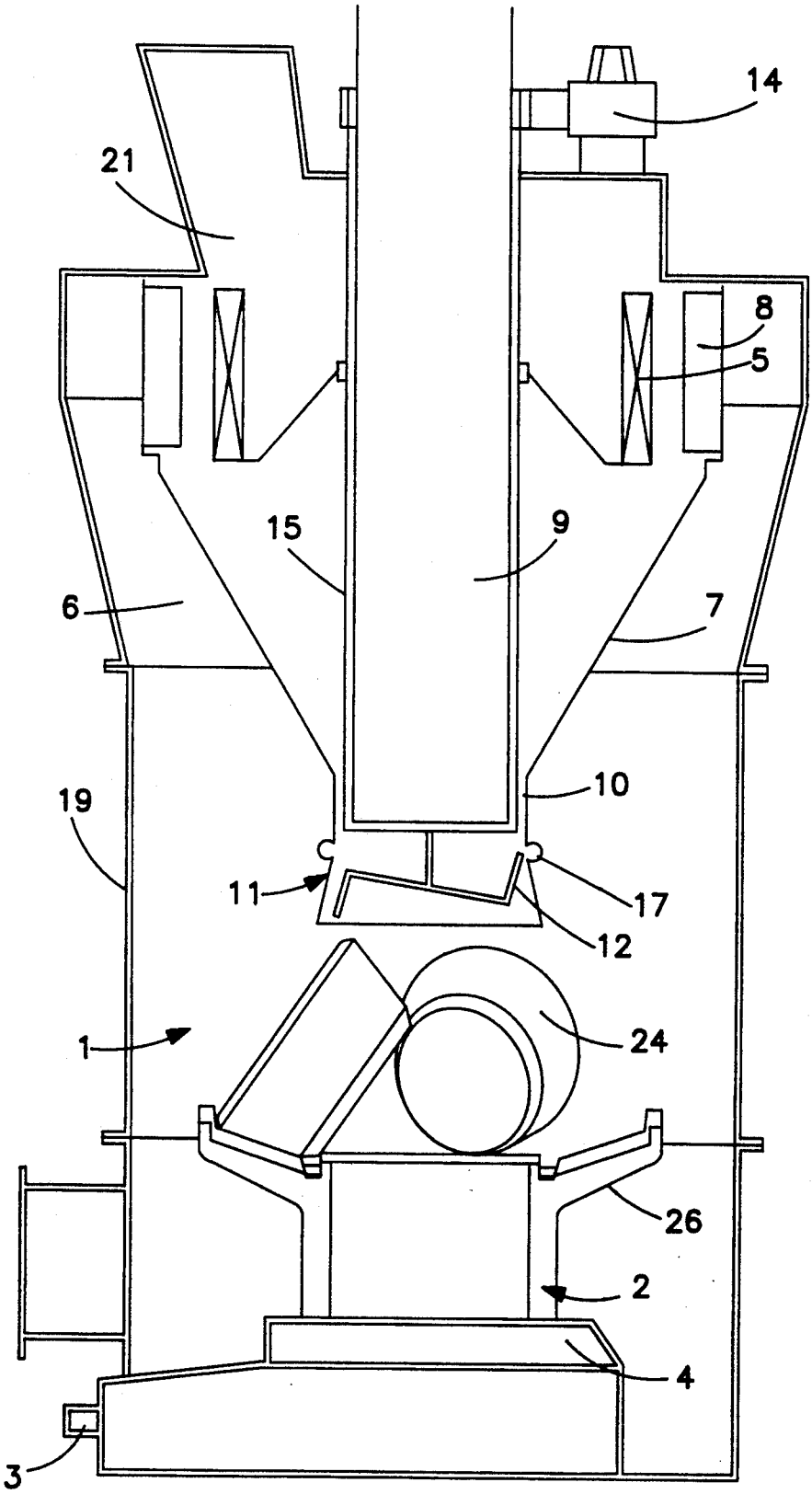
FIG. 1 is a schematic cross-sectional side elevation view of a rolling mill in accordance with a first embodiment of the invention.

With reference to FIG. 1, a rolling mill in accordance with a first embodiment of the invention is indicated generally at 1. The rolling mill 1 is connected, via a discharge conduit 21, to the coal dust charger of a steam generator, not shown. Mill 1 includes a mill housing 19. A rotary bowl mill, indicated generally at 2, is located within housing 19. Bowl mill 2 is of conventional construction and includes grinding rollers 24 and a rotary bowl 26. The bowl 26 is driven via a drive, not shown, through a shaft 3 and transmission 4.

In the FIG. 1 embodiment a rotary separator or classifier 5 is also located within housing 19 and positioned above the bowl mill 2. The classifier 5 is coaxial with a feed pipe 9 through which raw coal is delivered to the mill. Motion is imparted to classifier 5 by a drive 14 by means of a tubular drive shaft 15, drive shaft 15 itself being coaxial with feed pipe 9. The classifier 5 cooperates with a "trap lid" 8, i.e., a series of guide vanes which define passages extending between the interior of a collector funnel 7 and the feed channel 6 of the rolling mill 1. A carrier gas stream enters housing 19 below the bowl of bowl mill 2 and flows upwardly via channel 6 to an annular zone defined by the trap lid 8. This rising gas flow entrains pulverized material overflowing the bowl of the bowl mill 2. Material which has been ground to the desired degree of fineness will be passed by the classifier 5 and will exit housing 19 via conduit 21. Partially pulverized material, i.e., material rejected because of its coarseness, will fall downwardly into collector funnel 7 and will be directed back towards the bowl mill.

The lower end of the collector funnel 7 defines the housing of a stirring system which is indicated generally at 11. The raw coal being delivered to the mill via feed pipe 9 and the rejected coarse material from classifier 5 are delivered to the mixing zone of stirring system 11, the partially pulverized material flowing into this mixing zone via an annular space 10 between the throat portion of funnel 7 and an extension of the tubular drive shaft 15. A stirrer 12 is located in the mixing zone of the stirring system 11 and is coupled to drive shaft 15 so as to be rotated thereby.

A plurality of nozzles 17 are positioned to inject water into the stirring zone downstream of the discharge end of feed pipe 9 and upstream of stirrer 12. The nozzles 17 are connected to a source of water, not shown, and enable the moisture content of the mixture delivered to the bowl mill 2 to be controlled. In operation, and as partly described above, a carrier gas will entrain particulate matter overflowing the bowl 26 of the bowl mill 2 and will carry the particles upwardly via feed channel 6 to the trap lid 8. Turbulence will be imparted to the particulate material/carrier gas mixture by the trap lid and this turbulent mixture will be sifted by the classifier 5. The material separated out of the stream by classifier 5 will drop downwardly and be delivered via funnel 7 into the mixing zone of the stirring system 11 where it will be mixed with raw material supplied via feed pipe 9. The homogeneous mixture produced by the action of stirrer 12 will be supplied to the grinding zone in bowl mill 2.

Figure 2:
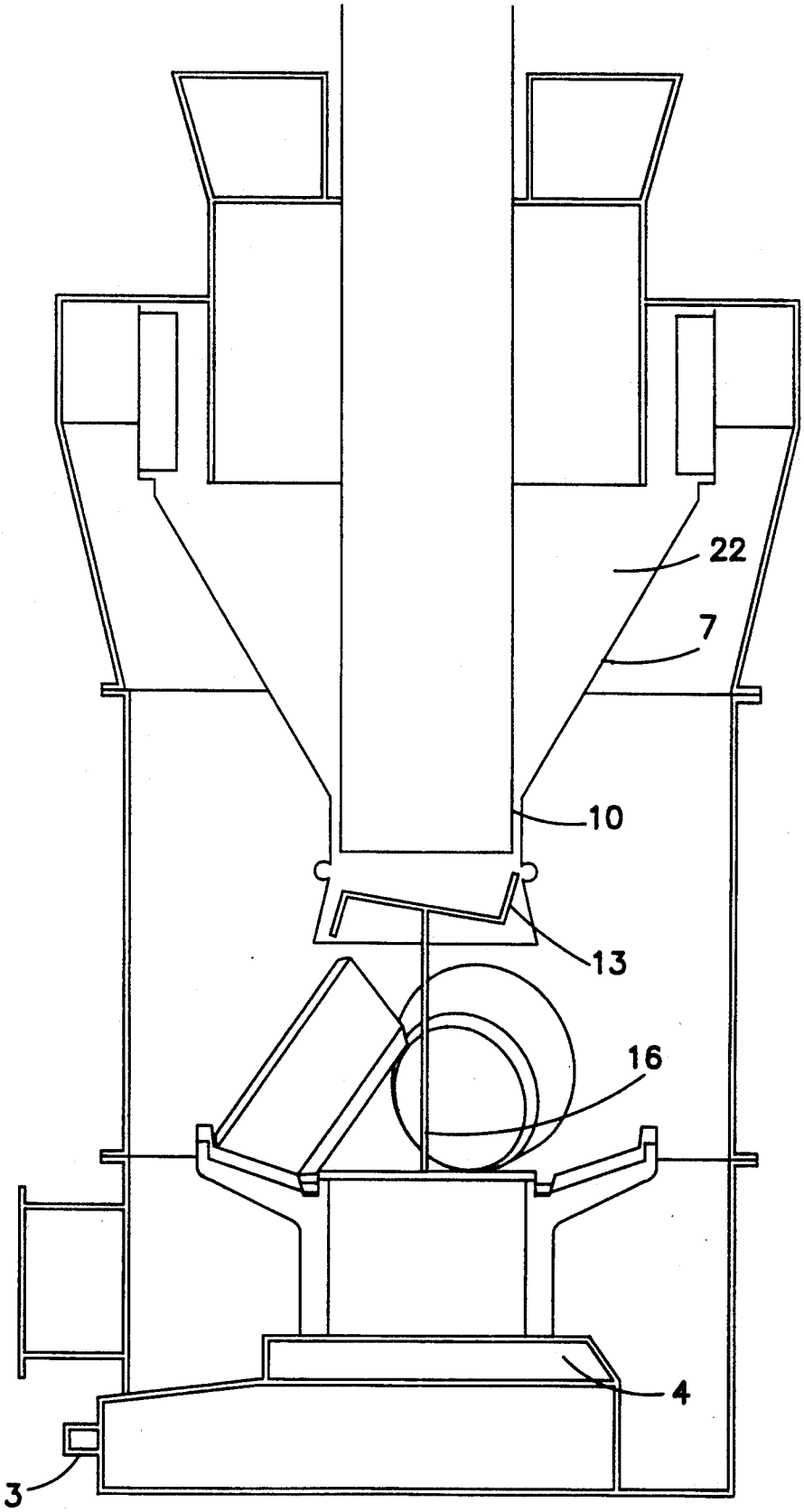
FIG. 2 is a view similar to FIG. 1 showing a second embodiment of the invention.

FIG. 2 depicts an embodiment of the invention which employs a centrifugal separator 22 which receives the particulate material/carrier gas mixture travelling upwardly within the mill housing. Thus, it may be seen that the present invention has applicability to any bowl mill regardless of the type of classifier employed to separate coarse material from the particulate matter/carrier gas stream prior to the exit of the pulverized material from the mill. In the FIG. 2 embodiment the stirrer 13 is driven from the drive which imparts rotary motion to the bowl 26 of the bowl mill 2, this drive being schematically depicted as a shaft 16.

As will be obvious to those skilled in the art, the stirrer 13 of the FIG. 2 embodiment could be incorporated into the embodiment of FIG. 1, i.e., the apparatus could employ a pair of serially arranged stirrers 12, 13 which are independently driven. In such case, depending upon operational requirements, the stirrers may either be rotated in the same or in opposite directions, the direction of rotation being determined by appropriate drive trains.

As will now also be obvious to those skilled in the art, the present invention ensures that a good mixture of the raw feed material with the coarse material returned from the separator is obtained and this mixing, in turn, results in the frictional forces within the grinding zone of the bowl mill being comparatively stable whereby the grinding operation will be performed efficiently and with minimum vibration and noise.

While preferred embodiments have been shown and described, various modifications and substitutions may be made thereto without departing from the spirit and scope of the invention. Accordingly, it is to understood that the present invention has been described by way of illustration and not limitation.

What is claimed is:

1. In a grinding mill having a rotatable bowl with associated grinding rollers, the mill having drive means for imparting rotation to the bowl and further having means for delivering raw material to be ground to the bowl, ground material which overflows the bowl being entrained in a carrier gas, the mill also including means for separating partially ground material of particle size above a preselected minimum from the carrier gas stream for return to the bowl for further grinding, the improvement comprising:

stirring means located upstream of the mill bowl in the direction of material flow, said stirring means establishing a stirring zone to which the raw material and separated partially ground material is delivered, said stirring means homogeneously mixing the raw material and partially ground material and releasing said mixture to the mill bowl.

2. The apparatus of claim 1 further comprising:

means for injecting water into said stirring means whereby the moisture content of the mixture delivered to the mill bowl may be controlled.

3. The apparatus of claim 1 wherein said stirring means comprises:

at least a first rotatable stirrer; and means mechanically coupling said first stirrer to the drive means for the mill bowl whereby the stirrer will be caused to rotate.

4. The apparatus of claim 3 further comprising:

means for injecting water into said stirring means whereby the moisture content of the mixture delivered to the mill bowl may be controlled.

5. The apparatus of claim 1 wherein the separating means of the mill comprises a rotary separator, the mill further having means for imparting rotation to the rotary separator, and wherein said stirring means comprises:

at least a first rotatable stirrer; and means mechanically coupling said first stirrer to the means for imparting rotation to the rotary separator whereby the stirrer will be caused to rotate.

6. The apparatus of claim 5 further comprising:

means for injecting water into said stirring means whereby the moisture content of the mixture delivered to the mill bowl may be controlled.

7. The apparatus of claim 5 wherein the means for imparting rotation to the rotary separator includes a tubular shaft which is coaxial with the means for delivering the raw material and wherein said coupling means comprises an extension of said tubular shaft.

8. The apparatus of claim 7 further comprising:

means for injecting water into said stirring means whereby the moisture content of the mixture delivered to the mill bowl may be controlled.

* * * * *